US006356168B1

(12) United States Patent
Barnett et al.

(10) Patent No.: US 6,356,168 B1
(45) Date of Patent: Mar. 12, 2002

(54) SHEET-METAL FILTER

(75) Inventors: Ron Barnett, Santa Rosa, CA (US); Zhengxiang Ma; Louis Thomas Manzione, both of Summit, NJ (US); Richard F. Schwartz, Plainsboro, NJ (US); Hui Wu, Milpitas, CA (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/666,192

(22) Filed: Sep. 21, 2000

Related U.S. Application Data

(63) Continuation-in-part of application No. 09/521,556, filed on Mar. 9, 2000, now abandoned.

(51) Int. Cl.[7] ..... H01P 1/203; H01P 7/00

(52) U.S. Cl. ..... 333/202; 333/246; 333/204; 333/219

(58) Field of Search ..... 333/204, 203, 333/246, 219, 202

(56) References Cited

U.S. PATENT DOCUMENTS

| | | | | |
|---|---|---|---|---|
| 2,945,195 A | * | 7/1960 | Matthaei | 333/204 |
| 3,104,362 A | | 9/1963 | Matthaei | 333/204 |
| 3,806,844 A | * | 4/1974 | Buckley et al. | 334/15 |
| 4,609,892 A | * | 9/1986 | Higgins, Jr. | 333/204 |
| 5,225,799 A | | 7/1993 | West et al. | 332/202 |
| 5,235,298 A | * | 8/1993 | Banno et al. | 333/204 |
| 5,352,996 A | | 10/1994 | Kawaguchi | 333/203 |
| 6,005,455 A | | 12/1999 | Lindell et al. | 333/134 |

FOREIGN PATENT DOCUMENTS

| | | |
|---|---|---|
| EP | 0 766 333 A1 | 9/1996 |

* cited by examiner

*Primary Examiner*—Robert Pascal
*Assistant Examiner*—Stephen E. Jones
(74) *Attorney, Agent, or Firm*—David Volejnicek

(57) ABSTRACT

A high-frequency, e.g., microwave, filter (100, 300, 400) is made, e.g., stamped or etched, from a single sheet (110, 310, 410) of electrically conductive material, e.g., a metal plate or a printed circuit board. The sheet defines a frame (112, 312, 412–413), one or more resonant filter elements (114, 311–315, 411–415) inside of the frame, one or more supports (116, 316–317, 416) connecting each resonant filter element to the frame, and a flange (118, 318, 418) on one of the resonant filter elements. The flange serves as an electrical contact to the filter; another flange (317, 417) on another element, or the frame itself, serves as a second contact. An electrically conductive housing (104, 304, 404) encapsulates both faces of the sheet.

12 Claims, 5 Drawing Sheets

SHEET-METAL FILTER

CROSS-REFERENCE TO A RELATED APPLICATION

This application is a continuation-in-part of application of R. Barnett et al., entitled "Sheet-Metal Filter", U.S. application Ser. No. 09/521,556, filed on Mar. 9, 2000, now abandoned.

TECHNICAL FIELD

This invention relates to high-frequency, e.g., microwave, filters.

BACKGROUND OF THE INVENTION

The recent proliferation of, and resulting stiff competition among, wireless communications products have put price/performance demands on filter components that conventional technologies find difficult to deliver. This is primarily due to expensive manufacturing operations such as milling, hand-soldering, hand-tuning, and complex assembly.

SUMMARY OF THE INVENTION

This invention is directed to solving this and other problems and disadvantages of the prior art. According to the invention, a filter is made from a single sheet of electrically conductive material, e.g., metal, preferably by stamping. The sheet is preferably all metal, e.g., a metal plate or a stacked assembly of metal sheets, but it may also be a metal-laminated non-conductive substrate, e.g., a printed-circuit board. In the latter case, the filter may advantageously be made by etching. An electromagnetically conductive housing preferably encapsulates at least both faces of the sheet. The sheet of conductive material defines a frame, one or more resonator filter elements inside of the frame, and one or more supports attaching the resonators to the frame. At least one contact connected to the resonator filter element provides an electromagnetic contact thereto. Preferably, the contact is a flange on at least one of the resonators, also defined by the sheet of conductive material. Another flange or the frame itself serves as another contact to the filter. Illustratively, the flanged resonator is rectangular and the flange and the supports extend from a side of the rectangle, whereby the distance between the flange and an end of the rectangular resonator that lies on the same side of the supports as the flange primarily determines the input characteristics of the filter. The resonant frequency of the filter element is primarily determined by the length of the element ($\lambda/2$). Other factors, such as the width, the thickness, the tap point (L), and the resonators proximity to other metal also determine the resonant frequency.

Major benefits of the invention include low manufacturing costs, narrow (illustratively about 1%) bandwidth filters requiring no tuning, and high Q, relative to conventional technology. These and other features and advantages of the invention will become more evident from the following description of an illustrative embodiment of the invention considered with the drawing.

DETAILED DESCRIPTION

Figure 1:
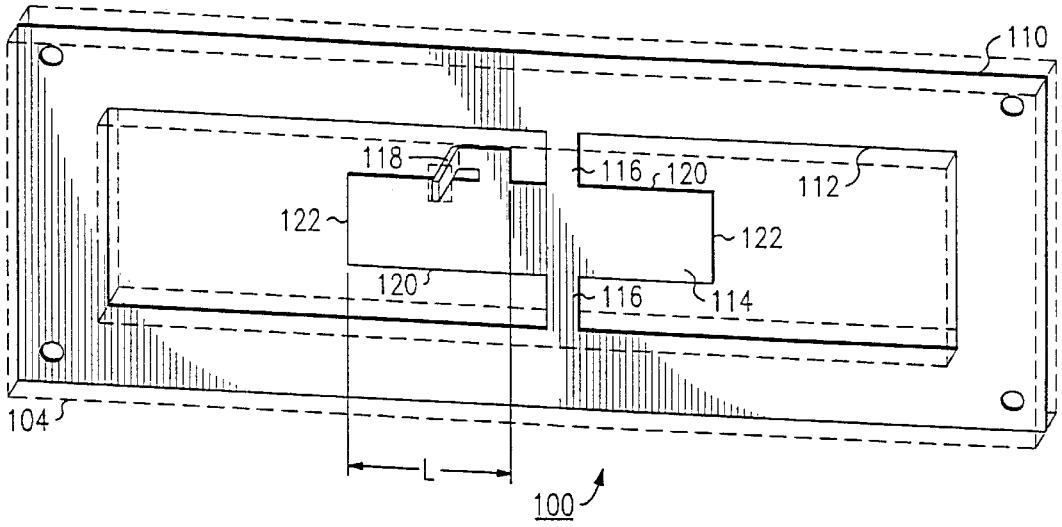
FIG. 1 is a perspective view of a filter that includes a first illustrative embodiment of the invention.
Figure 5:
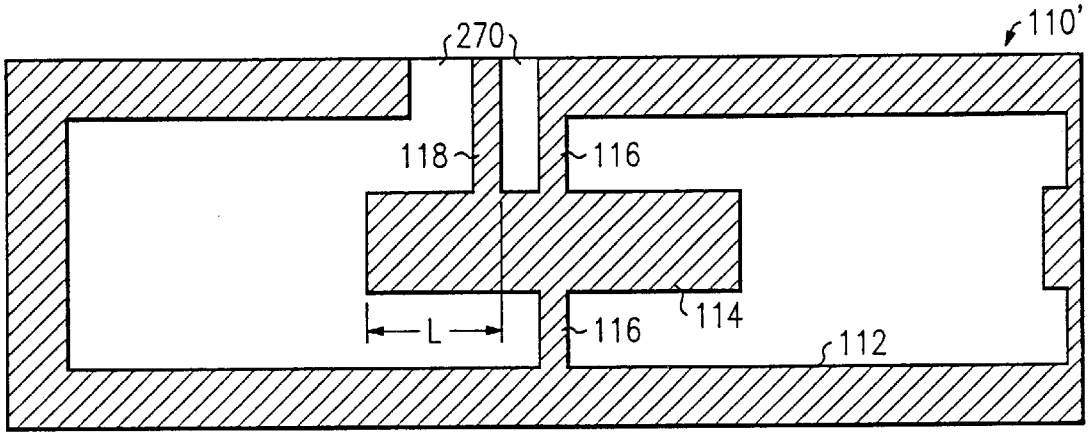
FIG. 5 is a perspective view of a filter that includes a second illustrative embodiment of the invention.

FIG. 1 shows a first bandpass filter 100, which comprises an electrically conductive (e.g., metallic) filter layer 110 positioned inside a cavity formed by an electrically conductive housing 104. The cavity is dimensioned to exhibit a waveguide cutoff frequency below the frequencies at which filter 100 is being used. Filter layer 110 is a single sheet of electrically conductive material, such as a sheet of aluminum, steel, kovar, copper, or molybdenum. All these metals should be plated with copper, gold, or silver to enhance their conductivity and corrosion resistance. Filter layer 110 also may be a metal-coated (laminated) insulating substrate, such as a printed-circuit board or plastic or ceramic. In the latter case, the printed-circuit may be metal-coated on both sides, with one of the sides forming a part of housing 104. In the case of being a single sheet of metal, filter layer 110 is easily manufactured by stamping or etching. In the case of being a laminate, filter layer 110 is easily manufactured by etching or plating, including edge plating. Cutting or other manufacturing methods may also be used. Filter layer 110 need not be planar. Outer portions thereof may be bent substantially perpendicularly to the rest to form a part of the walls of housing 104, or else are part of the interconnections between other filter layers or circuitry. Filter layer 110 comprises a frame 112, a resonator (resonant filter element) 114 inside of frame 112, supports 116 connecting resonator 114 to frame 112, and a coupler; a second, ground, contact is formed by frame 112 and supports 116. The coupler is shown in FIG. 1 as a contact flange 118 located at the 50 Ω tap point and extending from resonator 114, and acts as an inductive coupler. The coupler can also be an out-of-side coupler, or a capacitive coupler, or any other desired coupler. Flange 118 forms a tap point between supports 116 and edges 122 of resonator 114, so the closer flange 118 is to edge 122, the more energy it couples in at a higher frequency. The inductive coupler formed by flange 118 may extend from resonator 114 in the plane of filter element 110' through a gap 270 in frame 112, as shown in FIG. 5. This planar filter is enclosed in a closure formed by an electrically conductive housing 104, which behaves as a waveguide with a cut-off frequency lower than the second harmonic frequency of the filter center frequency. This planar configuration comprising filter element 110' as an input/output possesses up-down symmetry and nulls the coupling between the filter elements and the waveguide. Therefore it achieves automatic suppression of the waveguide modes which would otherwise be excited. As a consequence, the cut-off frequency of filter 100 is pushed up high, and the filter achieves very good suppression of second harmonics. However, flange 118 may be bent away from the plane of filter layer 110, as shown in FIG. 1, to extend outside of housing 104 through an opening 120 therein to form a connectorless coupling to, e.g., an antenna. The bent-up flange 118 destroys the up-down symmetry of filter layer 110' and hence destroys the suppression of the waveguide modes. In order to regain the high suppression of the waveguide modes at the second harmonic position, the bent-up flange 118 must be positioned at an integer multiple of waveguide half-wavelength of the second harmonic frequency of the filter's center frequency from the inside edge of frame 112. It renders the flange 118 in a null of the electromagnetic fields of the waveguide modes at the second harmonic frequency. Preferably, both frame 112 and resonator 114 are rectangular in shape.

Figure 2:
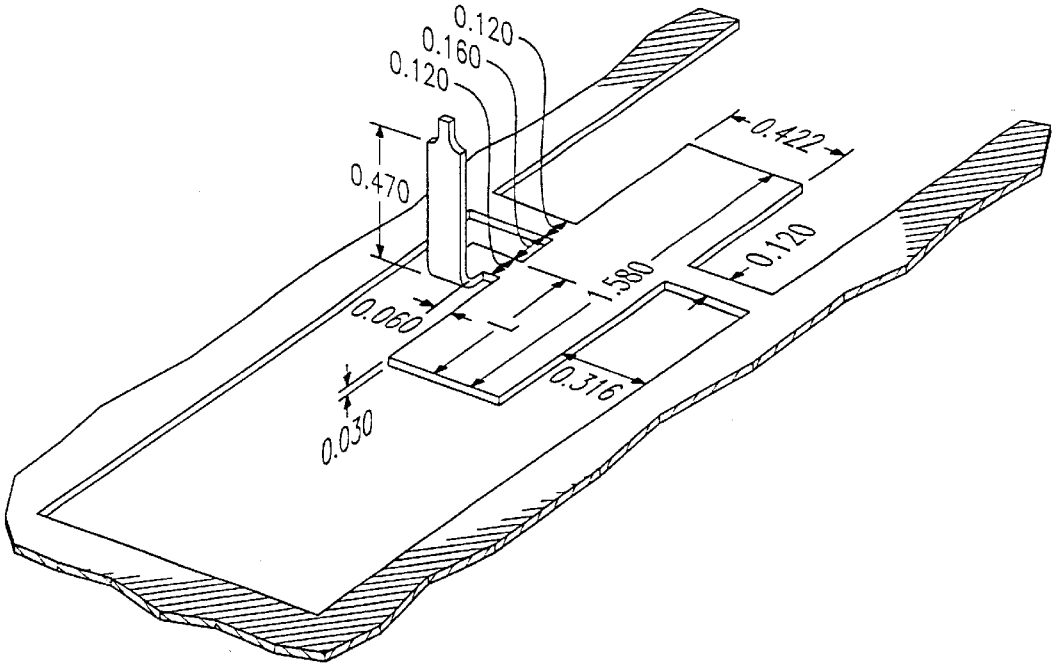
FIG. 2 shows illustrative dimensions of the resonant element of the filter of FIG. 1.
Figure 3:
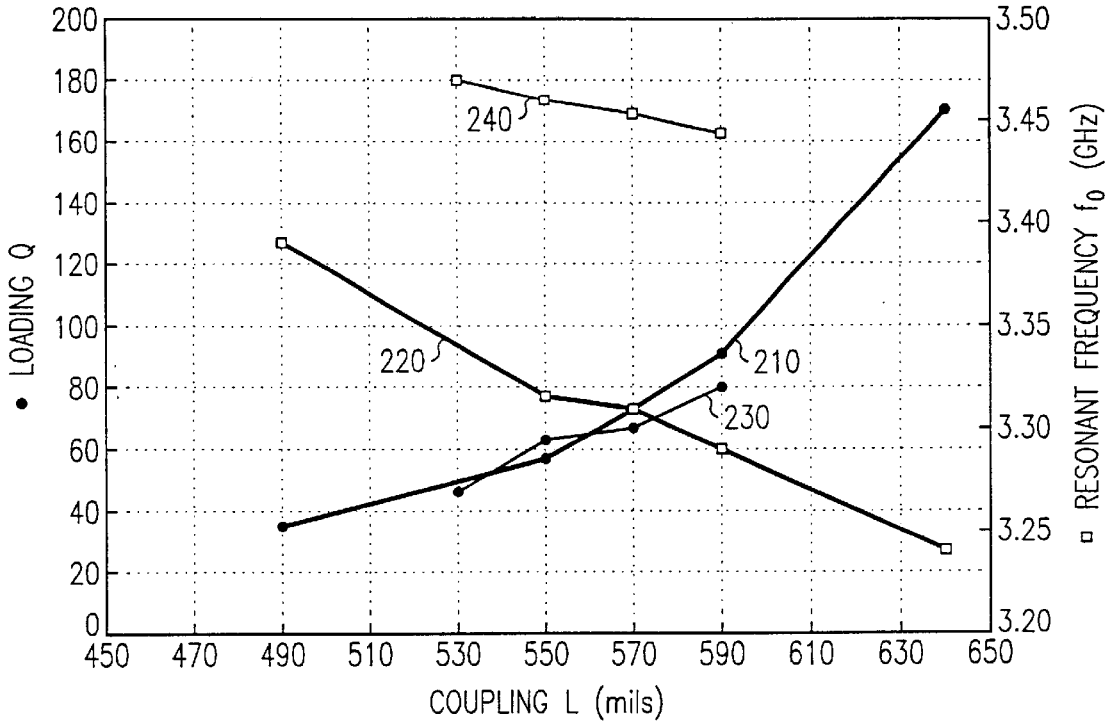
FIG. 3 is a graph of first operational characteristics of the resonant element of FIG. 2.

For a bandpass half-wavelength filter, the important parameters are the loaded Q of the end resonators (which forms the input/output coupling to the filter) the center frequency of each resonator, and the interresonator coupling coefficients. They can be calculated for the specific type of filter that is desired. Electromagnetic (EM) simulations are used to relate these parameters to the specific structures and physical dimensions of the resonators for realization of the filter, because it is usually very difficult if not impossible to solve the problems analytically due to the complexity of the studied structures. The dimensions of an illustrative end-coupling resonator 114 are shown in FIG. 2. The dimension "L" between the edge of flange 118 that is closest to support 116 and an end 122 of resonator 114 that lies on the same side of support 116 as flange 118 is critical in that it is determinative of the input/output characteristics—the loaded Q and the center frequency $f_0$ of filter 100 and the loaded Q of the input and output resonators. It also de-tunes the center frequency $f_0$ of the input and output resonators from their natural, unloaded, half-wavelength resonance. The relationship of the loaded Q and center frequency $f_o$ to the parameter L is determined by simulations, whose results are shown in FIG. 3 as curves 210 and 220. Simulations provide an invaluable means to study and optimize the overall structures through exploration of an enormous design space, which might be otherwise impossible. However, due to inaccuracy in EM modeling, several prototypes with dimensions close to those selected by simulations were built and measured to map out the exact dependence experimentally for fine adjustment to achieve a no-tuning design. Their results are also shown in FIG. 3 as curves 230 and 24. It is clear from FIG. 3 that the desired loading Q and the center frequency may not coincide with each other. However, variation of the resonator's length, such as lengthening or shortening both ends by the same amount, will only affect the center frequency but not the Q. Hence, desired Q and center frequency can be achieved simultaneously.

Figure 6:
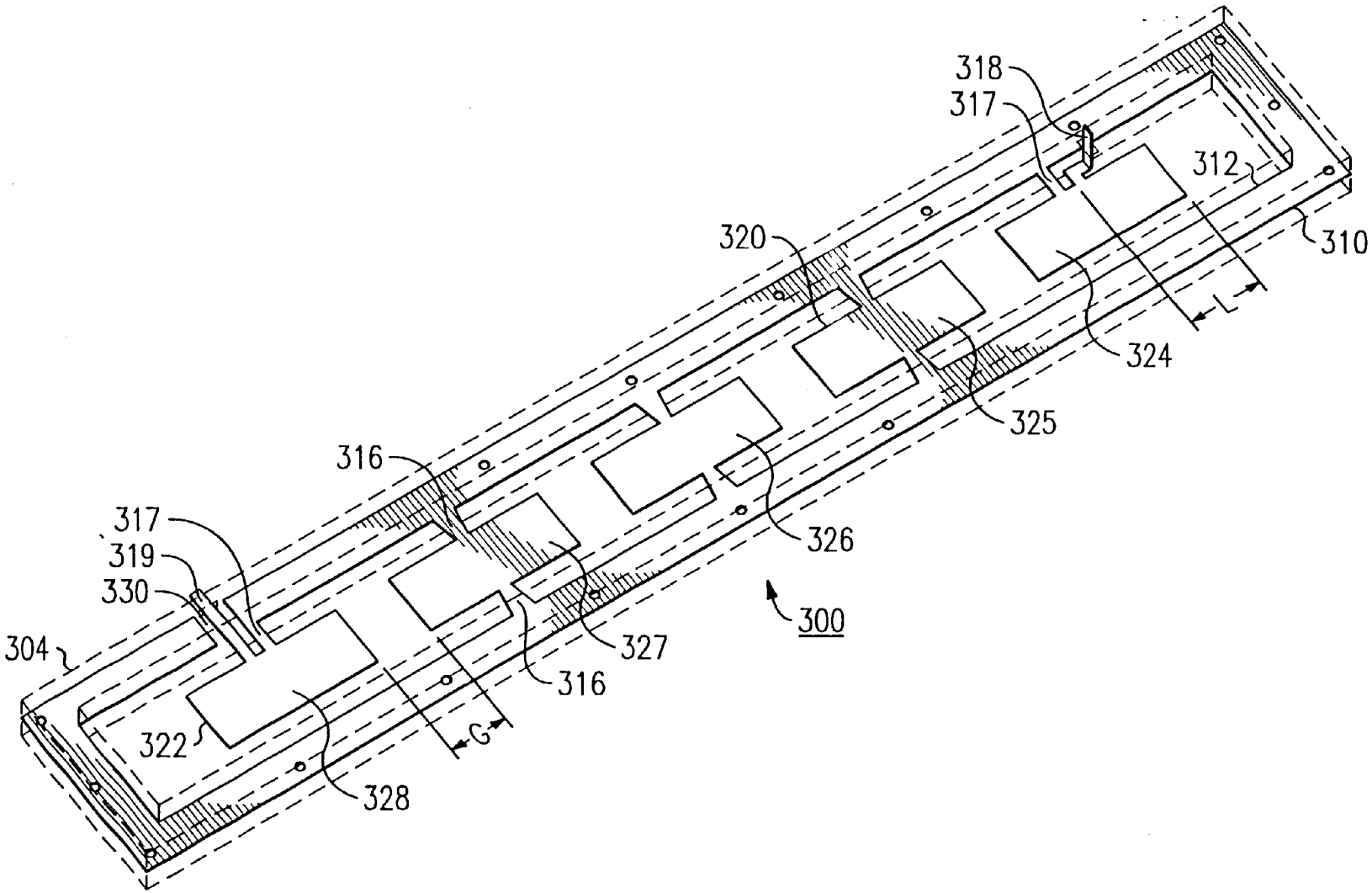
FIG. 6 is a perspective view of a filter that includes a third illustrative embodiment of the invention.

FIG. 6 shows a third filter 300, which comprises an electrically conductive filter layer 310 mounted inside an electrically conductive housing 304. Filter layer 310 is also a single sheet of material, and comprises five resonators 311–315 to form a five-pole filter. Resonators 311–315 are capacitively coupled to each other at their adjacent edges across gap G. Resonators 311–315 are positioned inside a frame 312 and are connected thereto by supports 316 and 317. Contact flanges 318 and 319 extend from sides 320 of the two outermost resonators 310 and 314. Filter layer 310 is also easily manufactured by stamping or etching. Flange 318 is bent away from the plane of filter element 310 and extends outside of housing 304 via orifice 322 to form a first contact to filter 300. Flange 319 extends outside of housing 304 through a gap 330 in frame 312 to form a second contact of filter 300. Suppression of the low-frequency parasitic mode is achieved by designing the end resonators 311 and 314 properly such that the center frequency of the parasitic mode of the end resonators 311 and 314 are very different from that of the inner resonators 312, 313, and 315.

Figure 4:
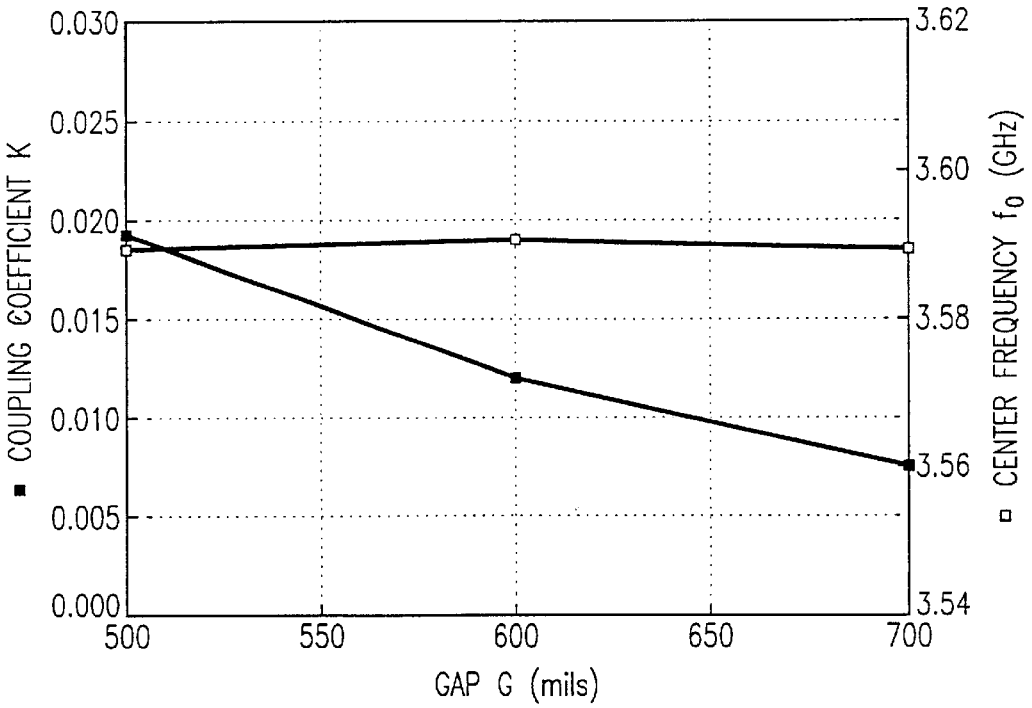
FIG. 4 is a graph of second operational characteristics of the resonant element of FIG. 2.

For the inner resonators, their center frequencies are mainly determined by their lengths, approximately inversely proportionally. The coupling between the resonators is determined by the gap G between them. Usually the coupling will have a weak effect on the center frequency, which should be taken into consideration. In general, gap G is hard to describe by an analytical mathematical formula; fortunately it is not necessary because the coupling effects can generally be found by measurement. The measured relationship between gap width G and the coupling coefficient K and center frequency $f_o$ for filter 300 that uses the five resonators of FIG. 6 is shown in FIG. 4. Coincidentally for this filter 300, because of its specific geometry, the center frequency is independent of the coupling coefficient K. Therefore, the desired center frequency of the resonators can be achieved by adjusting their lengths without regard for the gaps between the resonators. This makes the filter easier to design.

With all the relevant dimensions mapped out, a desired frequency response can be achieved at any frequency. In addition to the desired frequency response in the desired bands, a filter will often display some parasitic modes at the undesired places. They can be reduced or eliminated on a case-to-case basis by manipulating the structures in a way that suppresses those undesired modes but not the desired one by properly engineering the width and the shape of tabs 316 so that they do not perturb the desired modes of propagation in the resonant elements.

Figure 7:
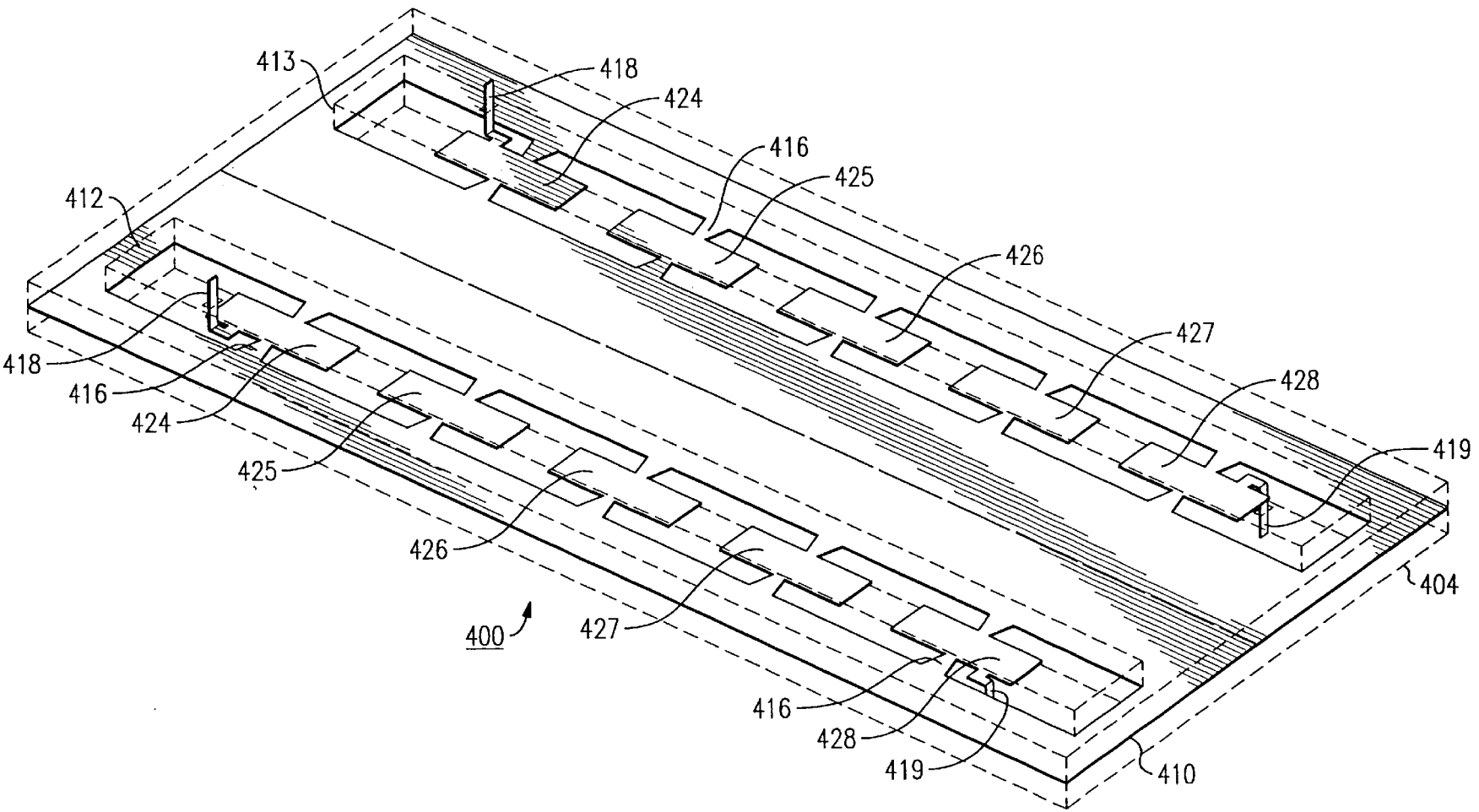
FIG. 7 is a perspective view of a filter that includes a fourth illustrative embodiment of the invention.

FIG. 7 shows a fourth filter 400, which also comprises an electromagnetically conductive filter layer 410 mounted inside an electromagnetically conductive housing 404. This design is particularity suited for implementing a transceiver duplexer. Filter layer 410 defines dual side-by-side five-pole filters. Of course, any desired number of filters may be defined by a single filter layer 410. The filters may be cascaded for better performance. Or, they may be used for different stages of a transmitter or a receiver. Or, one may be used for the transmitter and the other for the receiver of a wireless device. Filter layer 410 is a single sheet of material and defines two frames 412 and 413 each holding five resonators 424–428 that are connected thereto by supports 416. Of course, each of the filters may have a different number of resonators, of different dimensions, to achieve different filter characteristics. Contact flanges 419 and 418 extend from sides 420 of the two outermost resonators 424 and 428 in each frame 412 and 413 and establish the input/output coupling to filter 400. Alternately, this coupling can be obtained by coupling capacitively to the same elements 411 and 414. Filter layer 410 is likewise easily manufactured by stamping or etching. Flanges 418 and 419 are bent away from the plane of filter layer 410 and extend through orifice 422 outside of housing 404 to form a pair of contacts to each of the two filters.

Of course, various changes and modifications to the illustrative embodiments described above will be apparent to those skilled in the art. For example, the resonators may be twisted to lie at an angle to the plane of the filter frame, e.g., at 90° thereto. Such changes and modifications can be made without departing from the spirit and the scope of the invention and without diminishing its attendant advantages. It is therefore intended that such changes and modifications be covered by the following claims except insofar as limited by the prior art.

What is claimed is:

1. An electromagnetic filter comprising:

a single sheet of electrically conductive material defining a frame, at least one resonant filter element positioned inside the frame, and at least one support attaching each resonant filter element to the frame, wherein each support is rectangular or triangular in shape and has a length between the resonant filter element and the frame of about one-fourth of a wavelength of an operating frequency of the filter; and at least one contact connected to the resonant filter element for making an electric connection to the resonant filter element.

2. The filter of claim 1 further comprising:

an electrically conductive housing encapsulating both faces of the single sheet of electrically conductive material.

3. The filter of claim 1 wherein:

the contact comprises a flange defined by the single sheet of electrically conductive material and extending from the resonant filter element.

4. The filter of claim 1 wherein:

the frame and the support form a contact for making a second electric connection to the resonant filter element.

5. The filter of claim 1 wherein:

the frame defines a gap therethrough; and the at least one contact comprises a flange defined by the resonant filter element extending out of the frame through the gap.

6. The filter of claim 1 wherein:

the resonant filter element is rectangular in shape and has a coupling length L, comprising a dimension between an edge of the contact that is closest to the support and an end of the resonator that lies on a same side of the support as the contact, whose relationship to a selectivity of the filter is defined by FIG. 3.

7. The filter of claim 1 wherein:

the sheet is a sheet of metal.

8. The filter of claim 1 wherein:

the sheet is a metal layer carried by a nonconductive substrate layer.

9. A method of making the filter of claim 1 comprising:

stamping the frame, the resonator filter element, and the support out of the sheet.

10. A method of making the filter of claim 1 comprising:

etching the frame, the resonator filter element, and the support into the sheet.

11. The electromagnetic filter of claim 1 made by the method of claim 9 or 10.

12. An electromagnetic filter comprising:

a single sheet of electrically conductive material defining a frame, at least one resonant filter element positioned inside the frame, and at least one support attaching each resonant filter element to the frame;

at least one contact connected to the resonant filter element for making an electric connection to the resonant filter element; and wherein the resonant filter element is rectangular in shape and has a coupling length L, comprising a dimension between an edge of the contact that is closest to the support and an end of the resonator that lies on a same side of the support as the contact, whose relationship to a selectivity of the filter is defined by FIG. 3.

* * * * *